US007467484B2

(12) United States Patent
Chang et al.

(10) Patent No.: US 7,467,484 B2
(45) Date of Patent: Dec. 23, 2008

(54) ARTICLE OF FOOTWEAR WITH MIDSOLE HAVING MULTIPLE LAYERS

(75) Inventors: Leo Chang, Portland, OR (US); John Hlavacs, Portland, OR (US)

(73) Assignee: Nike, Inc., Beaverton, OR (US)

( * ) Notice: Subject to any disclaimer, the term of this patent is extended or adjusted under 35 U.S.C. 154(b) by 293 days.

(21) Appl. No.: 11/202,648

(22) Filed: Aug. 12, 2005

(65) Prior Publication Data

US 2007/0033833 A1 Feb. 15, 2007

(51) Int. Cl.
*A43B 13/12* (2006.01)
*A43B 13/14* (2006.01)

(52) U.S. Cl. ..... 36/30 R; 36/25 R; 36/28; 36/103

(58) Field of Classification Search ..... 36/25 R, 36/103, 28, 30 R, 31, 32 R
See application file for complete search history.

(56) References Cited

U.S. PATENT DOCUMENTS

| | | | | |
|---|---|---|---|---|
| 2,410,019 | A | 10/1946 | Davis | |
| 4,302,892 | A | 12/1981 | Adamik | |
| 4,364,188 | A | 12/1982 | Turner et al. | |
| 4,364,189 | A | 12/1982 | Bates | |
| 4,398,357 | A | 8/1983 | Batra | |
| 4,547,979 | A | 10/1985 | Harada et al. | |
| 4,551,930 | A | 11/1985 | Graham et al. | |
| 4,557,060 | A | 12/1985 | Kawashima | |
| 4,642,911 | A | 2/1987 | Talarico, II | |
| 4,654,983 | A | 4/1987 | Graham et al. | |
| 4,667,423 | A | 5/1987 | Autry et al. | |
| 4,730,402 | A | 3/1988 | Norton et al. | |
| 4,759,136 | A | 7/1988 | Stewart et al. | |
| 4,766,679 | A | 8/1988 | Bender | |
| 4,876,053 | A | 10/1989 | Norton et al. | |
| 5,025,573 | A | 6/1991 | Giese et al. | |
| 5,086,574 | A * | 2/1992 | Bacchiocchi | 36/35 R |
| 5,141,578 | A | 8/1992 | Yang | |
| 5,308,420 | A | 5/1994 | Yang | |
| 5,318,645 | A | 6/1994 | Yang | |
| 5,325,611 | A | 7/1994 | Dyer et al. | |
| 5,362,435 | A | 11/1994 | Volpe | |
| 5,396,675 | A | 3/1995 | Vincent et al. | |
| 5,435,077 | A | 7/1995 | Pyle | |
| 5,435,078 | A | 7/1995 | Pyle | |
| 5,572,805 | A | 11/1996 | Giese et al. | |
| 5,575,089 | A | 11/1996 | Giese et al. | |
| 5,595,003 | A * | 1/1997 | Snow | 36/28 |
| 5,787,610 | A | 8/1998 | Brooks | |
| RE35,905 | E | 9/1998 | Vincent et al. | |
| 5,921,004 | A | 7/1999 | Lyden | |
| 6,061,929 | A | 5/2000 | Ritter | |
| 6,389,713 | B1 * | 5/2002 | Kita | 36/30 R |
| 6,665,956 | B2 * | 12/2003 | Hay | 36/25 R |
| 6,748,675 | B2 * | 6/2004 | Sato | 36/30 R |
| 2004/0123493 | A1 * | 7/2004 | Russell | 36/28 |
| 2004/0148803 | A1 * | 8/2004 | Grove et al. | 36/103 |

* cited by examiner

*Primary Examiner*—Ted Kavanaugh
(74) *Attorney, Agent, or Firm*—Banner & Witcoff, Ltd.

(57) ABSTRACT

An upper for an article of footwear includes an upper and a sole assembly secured to the upper. The sole assembly includes an upper layer formed of a first material and a lower layer positioned beneath the upper layer and formed of a second material. At least one finger extends downwardly from at least a portion of a periphery of the upper layer.

41 Claims, 3 Drawing Sheets

ARTICLE OF FOOTWEAR WITH MIDSOLE HAVING MULTIPLE LAYERS

FIELD OF THE INVENTION

This invention relates generally to midsoles for articles of footwear and, in particular, to midsoles for articles of footwear having multiple layers.

BACKGROUND OF THE INVENTION

A conventional article of athletic footwear includes two primary elements, an upper and a sole assembly or sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower portion of the upper and is generally positioned between the foot and the ground. In addition to attenuating ground reaction forces (i.e., imparting cushioning), the sole structure may provide traction and control foot motions, such as pronation. Accordingly, the upper and the sole structure operate cooperatively to provide a comfortable structure that is suited for a variety of ambulatory activities, such as walking and running.

The sole structure of athletic footwear generally exhibits a layered configuration that includes a comfort-enhancing insole, a resilient midsole formed from a polymer foam material, and a ground-contacting outsole that provides both abrasion-resistance and traction. The midsole is the primary sole structure element that imparts cushioning and controls foot motions. It is desirable to provide superior cushioning with the midsole, as well as providing a long-lasting, wear-resisant and water resistant midsole.

It is an object of the present invention to provide an article of footwear that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide an article of footwear having lighter weight and improved durability. In accordance with a first aspect, an upper for an article of footwear includes an upper and a sole assembly secured to the upper. The sole assembly includes an upper layer formed of a first material and a lower layer positioned beneath the upper layer and formed of a second material. At least one finger extends downwardly from at least a portion of a periphery of the upper layer.

In accordance with another aspect, an article of footwear includes an upper and a midsole secured to the upper. The midsole includes an upper layer formed of a first material and a plurality of fingers extending downwardly about a periphery of a forefoot portion of the upper layer. A lower layer is positioned beneath the upper layer and is formed of a second material. The lower layer has at least one recess, with at least one finger being received in the at least one recess. An outsole is secured to the midsole.

In accordance with a further aspect, an article of footwear includes an upper and a sole assembly secured to the upper. The sole assembly has a midsole including a first portion formed of a first material having a first property and having a plurality of fingers extending downwardly about a least a portion of a periphery of a bottom surface thereof. A second portion is positioned beneath the first portion, and is formed of a second material having a second property different than the first property of the first portion. The second portion has a raised central portion, with the fingers extending downwardly about the raised central portion.

Substantial advantage is achieved by providing an article of footwear with a midsole having multiple layers. In particular, certain preferred embodiments of the present invention can provide footwear with improved wear-resistance while at the same time reducing the weight of the footwear.

These and additional features and advantages of the invention disclosed here will be further understood from the following detailed disclosure of certain preferred embodiments.

Figure 1:
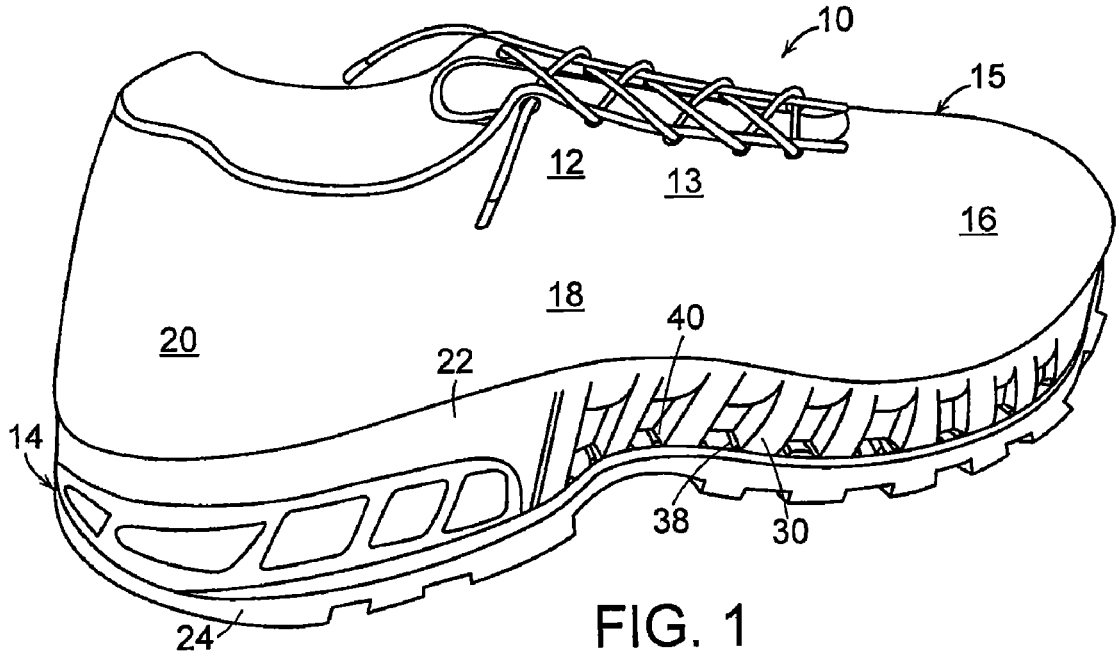
FIG. 1 is a perspective view of an embodiment of an article of footwear.

The figures referred to above are not drawn necessarily to scale and should be understood to provide a representation of the invention, illustrative of the principles involved. Some features of the article of footwear depicted in the drawings have been enlarged or distorted relative to others to facilitate explanation and understanding. The same reference numbers are used in the drawings for similar or identical components and features shown in various alternative embodiments. Articles of footwear as disclosed herein would have configurations and components determined, in part, by the intended application and environment in which they are used.

DETAILED DESCRIPTION OF CERTAIN PREFERRED EMBODIMENTS

The present invention may be embodied in various forms. A preferred embodiment of an article of footwear 10 is shown in FIG. 1. Footwear 10 includes an upper 12 and a sole assembly 14 secured to upper 12. Footwear 10 has a medial, or inner, side 13 and a lateral, or outer, side 15. For purposes of general reference, footwear 10 may be divided into three general portions: a forefoot portion 16, a midfoot portion 18, and a heel portion 20. Portions 16, 18, and 20 are not intended to demarcate precise areas of footwear 10. Rather, portions 16, 18, and 20 are intended to represent general areas of footwear 10 that provide a frame of reference during the following discussion.

Unless otherwise stated, or otherwise clear from the context below, directional terms used herein, such as rearwardly, forwardly, beneath, rear, front, inwardly, downwardly, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 20, that is, to the left as seen in FIG. 1. Naturally, forwardly is toward forefoot portion 16, that is, to the right as seen in FIG. 1, and downwardly is toward the bottom of the page as seen in FIG. 1. Inwardly is toward the center of footwear 10, and outwardly is toward the outer peripheral edge of footwear 10.

Sole assembly 14, which is generally disposed between the foot of the wearer and the ground, provides attenuation of ground reaction forces (i.e., imparting cushioning), traction, and may control foot motions, such as pronation. As with conventional articles of footwear, sole assembly 14 may include an insole (not shown) located within upper 12, a midsole 22, and an outsole 24. Midsole 22 is positioned beneath upper 12 and functions as the primary shock-attenuating and energy-absorbing component of footwear 10. Midsole 22 may be secured to upper 12 by adhesive or other suitable means.

Outsole 24 is positioned beneath midsole 22 and may be secured to midsole 22 by adhesive or other suitable means. Suitable materials for outsole 24 include rubber and carbon rubber, for example. Other suitable materials for outsole 24 will become readily apparent to those skilled in the art, given the benefit of this disclosure. In certain embodiments, sole assembly 14 may not include an outsole layer separate from midsole 22 but, rather, the outsole comprises a bottom surface of midsole 22 that provides the external traction surface of sole assembly 14.

Figure 2:
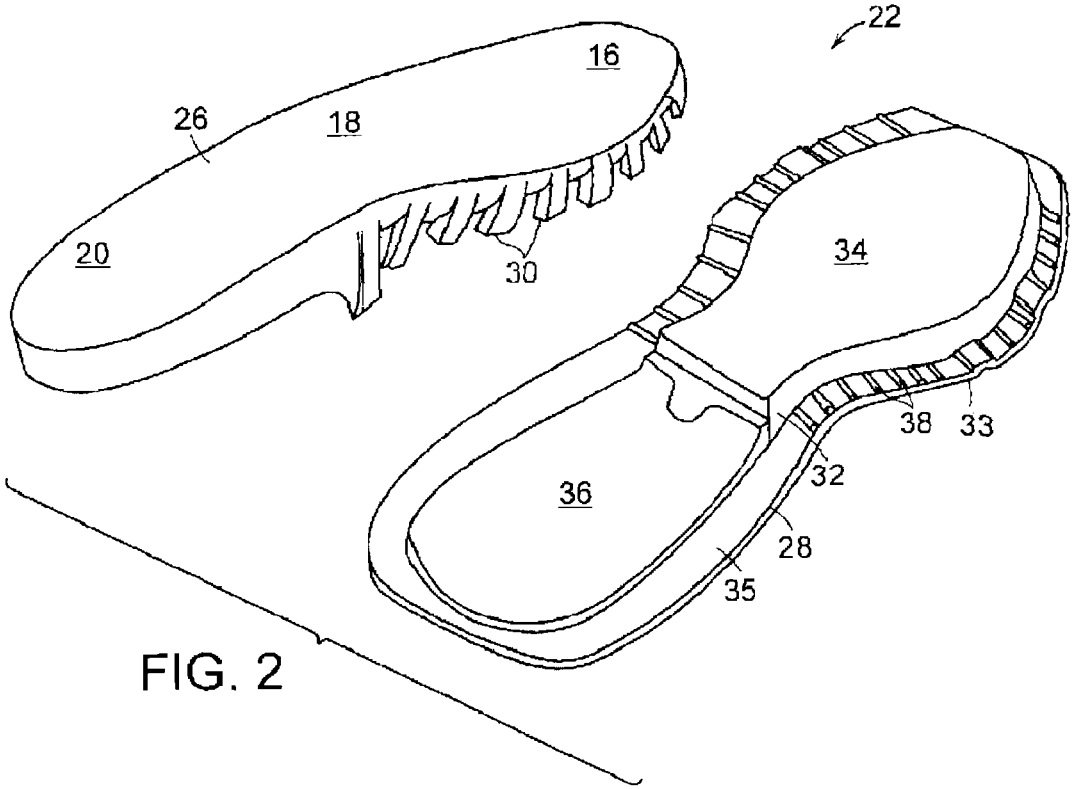
FIG. 2 is a perspective view, in exploded form, of the midsole of the article of footwear of FIG. 1.

As seen in FIG. 2 in exploded form, midsole 22 includes an upper layer 26 formed of a first material and a lower layer 28 positioned beneath upper layer 26 and formed of a second material that is different than the first material. In certain embodiments, the first material has a density greater than the density of the second material. In other embodiments, the second material has a resistance to moisture that is greater than the resistance to moisture of the first material. In other embodiments, the first material is more wear resistant than the second material. In certain embodiments, the first material is polyurethane (PU) and the second material is ethyl vinyl acetate (EVA).

Polyurethane is stiffer and more wear-resistant than EVA, thus it will not break down as quickly as the EVA material. The EVA material, on the other hand, is lighter than the PU material, helping to reduce the overall weight of footwear 10, and is also more water resistant.

Upper layer 26 has a plurality of fingers 30 extending downwardly from a lower surface thereof about at least a portion of a perimeter thereof. As illustrated in FIG. 2, fingers 30 extend downwardly about midfoot portion 18 and forefoot portion 16 of upper layer 26.

Lower layer 28 includes a raised central portion 32 and a flange 33 extending about the periphery of lower layer 28 defining a recess 35 about the periphery of lower layer 28. Fingers 30 extend into recess 35 about the periphery of raised central portion 32 and are seated on flange 33.

In the illustrated embodiment, raised central portion 32 includes a first portion 34 and a second portion 36. First portion 34 is positioned in midfoot portion 18 and forefoot portion 16 of lower layer 28 and second portion 36 is positioned in heel portion 20 of lower layer 28. In the illustrated embodiment, first portion 34 of lower layer 28 has a height greater than a height of second portion 36. Each of a plurality of ribs 38 extends outwardly along an upper surface of flange 33. Fingers 30 are seated in recess 35 on flange 33 adjacent first portion 34 and between selected adjacent ribs 38 about the periphery of lower layer 28.

Fingers 30, by extending downwardly about the periphery of lower layer 28 provide a stiffer and more wear-resistant area around lower layer 28, thereby providing improved support for footwear 10.

Figure 3:
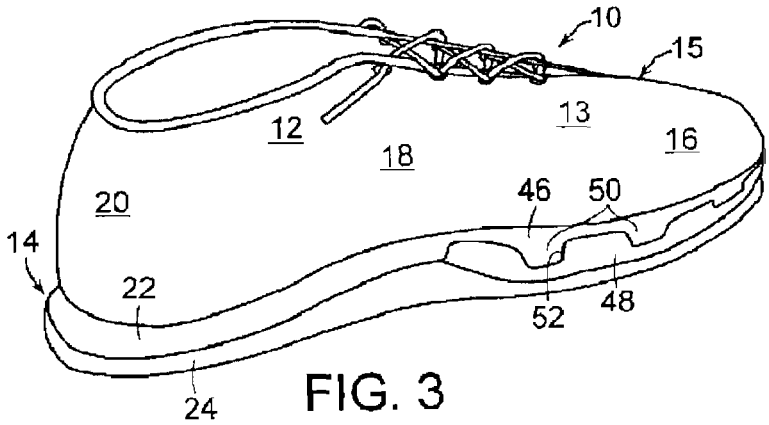
FIG. 3 is a perspective view of an alternative embodiment of an article of footwear.
Figure 4:
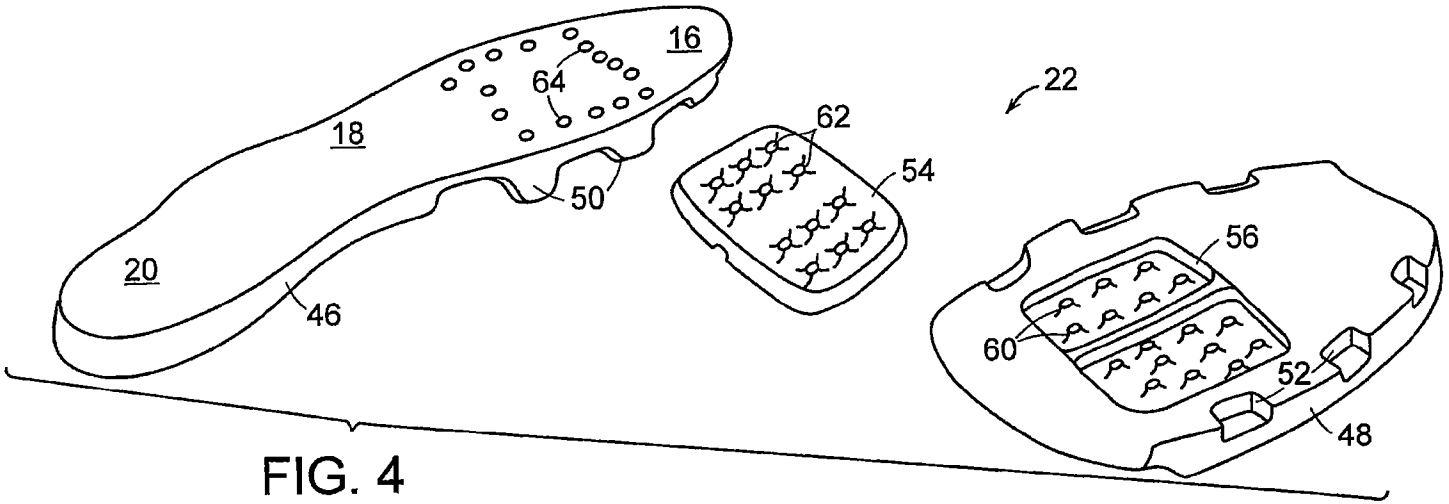
FIG. 4 is a perspective view, in exploded form, of the midsole of the article of footwear of FIG. 3.
Figure 5:
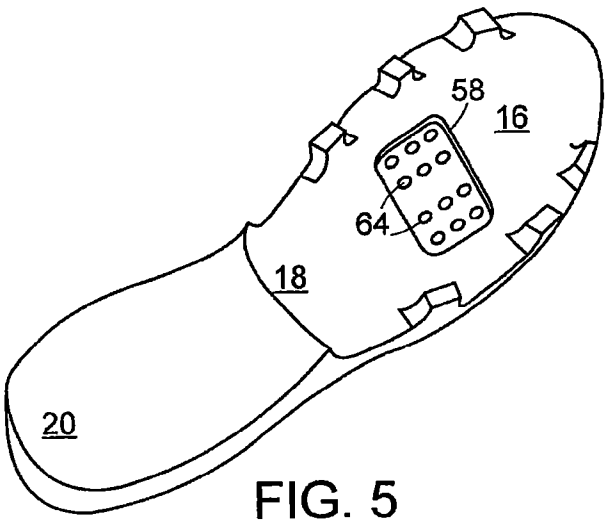
FIG. 5 is a perspective view of the bottom of the upper layer of the midsole of FIG. 4.

Another embodiment is illustrated in FIGS. 3-5, in which midsole 22 includes an upper layer 46 formed of a first material and a lower layer 48 positioned beneath upper layer 46 and formed of a second material that is different than the first material. In certain embodiments, lower layer 48 extends under only forefoot portion 16 of upper layer 46.

In certain embodiments, the first material has a density and weight greater than the density and weight of the second material. In other embodiments, the second material has a resistance to moisture that is greater than the resistance to moisture of the first material. In other embodiments, the first material is more wear resistant than the second material. In certain embodiments, the first material is polyurethane (PU) and the second material is ethyl vinyl acetate (EVA).

Upper layer 46 has a plurality of fingers 50 extending downwardly from a lower surface thereof about at least a portion of a perimeter thereof. As illustrated in FIG. 4, fingers 50 extend downwardly about forefoot portion 16 of upper layer 46. A plurality of recesses 52 is formed about a periphery of forefoot portion 16 of lower layer 48. Each finger 50 is received in a corresponding recess 50.

In certain embodiments, a fluid-filled bag 54 is positioned between upper layer 46 and lower layer 48. Fluid-filled bag 54 may be filled with air or any other suitable fluid. In the illustrated embodiment, fluid-filled bag 54 is positioned in forefoot portion 16 of midsole 22. As seen in FIG. 4, a recess 56 is formed in an upper surface of lower layer 48 when lower layer 48 is formed, such as by compression or injection molding, and receives a portion of fluid-filled bag 54. Similarly, as seen in FIG. 5, a recess 58 is formed in a lower surface of upper layer 46 and receives a portion of fluid-filled bag 54. Fluid-filled bag 54 provides additional support in the forefoot region of footwear 10.

A plurality of projections 60 may extend upwardly from the lower surface of recess 56 of lower layer 48, and are received in corresponding recesses formed in the lower surface of fluid-filled bag 54 (not shown). A plurality of recesses 62 is also formed in an upper surface of fluid-filled bag 54. When forming upper layer 46, fluid-filled bag 54 is positioned in a mold, and a plurality of locating pins (not shown) serve to register and align fluid-filled bag 54 in the proper position within the mold. The material, such as polyurethane, for example, used to form upper layer 46 is then poured into the mold over fluid-filled bag 54, and flows into recesses 62 and around the locating pins. Since the material flows about the locating pins, a plurality of apertures 64 remain in forefoot portion 16 of upper layer 46 when the upper layer 46 is removed from the mold.

In the illustrated embodiment, fingers 30 have a substantially rectangular cross-section. It is to be appreciated, however, that fingers 30 may have any desired cross-section and that other suitable cross-sections of fingers 30 will become readily apparent to those skilled in the art, given the benefit of this disclosure.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. An upper for an article of footwear comprising, in combination:

an upper; and a sole assembly secured to the upper and comprising:

an upper layer formed of a first material and having a central portion and a periphery surrounding the central portion;

a lower layer positioned beneath the upper layer and formed of a second material and in direct contact with the upper layer with no other material therebetween; and at least one finger extending downwardly from at least a portion of the periphery of the upper layer, the central portion of the upper layer being free of fingers, each finger being seated on the lower layer.

2. The article of footwear of claim 1, wherein the first material has a density greater than a density of the second material.

3. The article of footwear of claim 1, wherein the second material has a resistance to moisture greater than a resistance to moisture of the first material.

4. The article of footwear of claim 1, wherein the second material has a weight less than a weight of the first material.

5. The article of footwear of claim 1, wherein the first material is more wear resistant than the second material.

6. The article of footwear of claim 1, wherein the first material is polyurethane.

7. The article of footwear of claim 1, wherein the second material is ethyl vinyl acetate.

8. The article of footwear of claim 1, further comprising a plurality of fingers extending downwardly from a perimeter of a forefoot portion of the upper layer.

9. The article of footwear of claim 8, further comprising a recess formed about a periphery of the lower layer, the fingers of the upper layer received in the recess of the lower layer.

10. The article of footwear of claim 8, further comprising a plurality of recesses formed about a periphery of the lower layer, each recess receiving a finger of the upper layer.

11. The article of footwear of claim 8, further comprising a raised central portion extending upwardly in a forefoot portion of the lower layer, the fingers of the upper layer seated about a periphery of the raised central portion of the lower layer.

12. The article of footwear of claim 1, wherein the lower layer extends beneath only a forefoot portion of the upper layer.

13. The article of footwear of claim 1, further comprising a fluid-filled bladder positioned between the upper layer and the lower layer.

14. The article of footwear of claim 13, further comprising a recess formed in an upper surface of the lower layer, the fluid-filled bladder being received in the recess.

15. The article of footwear of claim 14, further comprising:

a plurality of projections extending upwardly from a lower surface of the recess; and a plurality of recesses formed in a lower surface of the fluid-filled bladder, each projection being received in a corresponding recess.

16. The article of footwear of claim 13, further comprising a recess formed in a lower surface of the upper layer, the fluid-filled bladder being received in the recess.

17. The article of footwear of claim 13, wherein the fluid-filled bladder is positioned between a forefoot portion of the upper layer and a forefoot portion of the lower layer.

18. The article of footwear of claim 1, further comprising an outsole, the upper layer and lower layer positioned between the upper and the outsole.

19. An article of footwear comprising, in combination:

an upper;

a midsole secured to the upper and comprising:

an upper layer formed of a first material and having a central portion and a periphery surrounding the central portion;

a plurality of fingers extending downwardly about the periphery of a forefoot portion of the upper layer, the central portion of the upper layer being free of fingers;

a lower layer positioned beneath the upper layer and formed of a second material and in direct contact with the upper layer with no other material therebetween; and at least one recess in the lower layer, each recess receiving at least one finger, each finger being seated on the lower layer; and an outsole secured to the midsole.

20. The article of footwear of claim 19, wherein the first material has a density greater than a density of the second material.

21. The article of footwear of claim 19, wherein the second material has a resistance to moisture greater than a resistance to moisture of the first material.

22. The article of footwear of claim 19, wherein the second material has a weight less than a weight of the first material.

23. The article of footwear of claim 19, wherein the first material is more wear resistant than the second material.

24. The article of footwear of claim 19, wherein the first material is polyurethane.

25. The article of footwear of claim 19, wherein the second material is ethyl vinyl acetate.

26. The article of footwear of claim 19, further comprising a recess formed about a periphery of the lower layer, the fingers of the upper layer received in the recess of the lower layer.

27. The article of footwear of claim 19, further comprising a plurality of recesses formed about a periphery of the lower layer, each recess receiving a finger of the upper layer.

28. The article of footwear of claim 19, further comprising a raised central portion extending upwardly in a forefoot portion of the lower layer, the fingers of the upper layer seated about a periphery of the raised central portion of the lower layer.

29. The article of footwear of claim 19, wherein the lower layer extends beneath only a forefoot portion of the upper layer.

30. The article of footwear of claim 19, further comprising a fluid-filled bladder positioned between the upper layer and the lower layer.

31. The article of footwear of claim 30, further comprising a recess formed in an upper surface of the lower layer, the fluid-filled bladder being received in the recess.

32. The article of footwear of claim 30, further comprising a recess formed in a lower surface of the upper layer, the fluid-filled bladder being received in the recess.

33. The article of footwear of claim 19, wherein the fluid-filled bladder is positioned between a forefoot portion of the upper layer and a forefoot portion of the lower layer.

34. An article of footwear comprising, in combination:

an upper;

a sole assembly secured to the upper and including a midsole comprising:

a first portion formed of a first material having a central portion, a periphery surrounding the central portion, a first property and having a plurality of fingers extending downwardly about at least a portion of the periphery of a bottom surface thereof, the central portion of the first portion being free of fingers; and a second portion positioned beneath the first portion and in direct contact with the first portion with no other material therebetween, formed of a second material having a second property different than the first property of the first portion, and having a raised central portion, the fingers extending downwardly about the raised central portion and being seated on the second portion.

35. The article of footwear of claim 34, wherein the downwardly extending fingers are positioned in a midfoot portion of the first portion and a forefoot portion of the first portion.

36. The article of footwear of claim 34, wherein the raised central portion extends from a midfoot portion of the first portion to a front edge of a forefoot portion of the first portion.

37. The article of footwear of claim 34, wherein the first portion has a density greater than a density of the second portion.

38. The article of footwear of claim 34, wherein the second material has a resistance to moisture greater than a resistance to moisture of the first material.

39. The article of footwear of claim 34, wherein the second material has a weight less than a weight of the first material.

40. The article of footwear of claim 34, wherein the first material is more wear resistant than the second material.

41. The article of footwear of claim 34, further comprising a fluid-filled bladder positioned between the upper layer and the lower layer.

* * * * *